US006866830B2

(12) United States Patent
Kwak

(10) Patent No.: US 6,866,830 B2
(45) Date of Patent: Mar. 15, 2005

(54) SYSTEM FOR CONTINUOUSLY PREPARING GASOLINE, KEROSENE AND DIESEL OIL FROM WASTE PLASTICS

(76) Inventor: Ho-Jun Kwak, 340-10 Daebang-dong, Chang-won shi, Kyungsangnam-do, 641-100 (KR)

( * ) Notice: Subject to any disclaimer, the term of this patent is extended or adjusted under 35 U.S.C. 154(b) by 45 days.

(21) Appl. No.: 10/243,387

(22) Filed: Sep. 13, 2002

(65) Prior Publication Data

US 2003/0019789 A1 Jan. 30, 2003

Related U.S. Application Data

(63) Continuation of application No. PCT/KR00/00373, filed on Apr. 20, 2000.

(30) Foreign Application Priority Data

Mar. 20, 2000 (KR) ..... 10-2000-0014033

(51) Int. Cl.[7] ..... B01J 8/04

(52) U.S. Cl. ..... 422/193; 212/213; 212/216; 212/218; 212/223; 212/233

(58) Field of Search ..... 422/193, 216, 422/218, 196, 200, 211, 212, 213, 214, 215, 219, 220, 223, 233; 202/153

(56) References Cited

U.S. PATENT DOCUMENTS 4,175,211 A * 11/1979 Chen et al. ..... 585/241
4,584,421 A * 4/1986 Saito et al. ..... 585/241
4,670,226 A * 6/1987 Furuyama et al. ..... 422/216
4,912,273 A * 3/1990 Harandi et al. ..... 585/322
4,968,409 A * 11/1990 Smith ..... 208/157
5,169,607 A * 12/1992 Krambrock et al. ..... 422/219
5,527,512 A * 6/1996 Bachtel et al. ..... 422/143
5,584,986 A * 12/1996 Bartholic ..... 208/151
5,744,668 A * 4/1998 Zhou et al. ..... 585/241
5,849,964 A * 12/1998 Holighaus et al. ..... 585/241
6,133,491 A * 10/2000 Xing ..... 585/241
6,534,689 B1 * 3/2003 Stankevitch ..... 585/241

FOREIGN PATENT DOCUMENTS

| | | |
|---|---|---|
| CN | 1123822 | 6/1996 |
| EP | 0675189 B1 | 4/1995 |
| EP | 0675189 A1 | 4/1995 |
| JP | 10 251656 | 9/1998 |

OTHER PUBLICATIONS

International Search Report for PCT/KR 00/00373.

* cited by examiner

*Primary Examiner*—N. Bhat
(74) *Attorney, Agent, or Firm*—Graybeal Jackson Haley, LLP

(57) ABSTRACT

The present invention relates to a method and system for the continuous preparation of gasoline, kerosene, and diesel oil from waste plastics. The method comprises the steps of: subjecting a melt of the waste plastics to a first catalytic reaction in which the waste plastic melt is in contact with a nickel or nickel alloy catalyst to be dehydrogenated while being decomposed; subjecting the dehydrogenated and decomposed waste plastic melt to a fluid catalytic cracking, as a second catalytic reaction to produce a gasoline-based fraction at a high fraction; fractionating the cracked material into a gasoline-based fraction, a kerosene fraction, and a diesel oil fraction; and reforming the gasoline-based fraction to produce a high octane number gasoline. The present invention can apply to a small scale facility, not to apply to a large scale facility. Also, the present invention allows gasoline to be prepared from the waste plastics in a high fraction and an efficient manner, thereby contributing to resource reclamation and environment protection.

13 Claims, 3 Drawing Sheets

SYSTEM FOR CONTINUOUSLY PREPARING GASOLINE, KEROSENE AND DIESEL OIL FROM WASTE PLASTICS

CROSS-REFERENCE TO RELATED APPLICATIONS

This is a continuation application which claims priority from PCT/KR00/00373, published in English, filed Apr. 20, 2000, based on Korean patent application 2000-014033, filed Mar. 20, 2000, and also claims priority from Korean Application No. 2000-014033, filed Mar. 20, 2000

DESCRIPTION

The present invention relates in general to a method and system for the continuous preparation of gasoline, kerosene and diesel oil from waste plastics. More particularly, the present invention relates to a method and system for the continuous preparation of gasoline, kerosene and diesel oil, which comprises dehydrogenating and decomposing waste plastics, and then subjecting the resulting waste plastics to moving-bed catalytic cracking, and which is particularly suitable for application in a small scale facility. The present invention allows a gasoline-based fraction to be obtained in high fraction, and also has advantages, particularly in the view of environmental protection and resource reclamation.

BACKGROUND OF THE INVENTION

Recently, the reclamation of waste plastics is of great interest throughout the world in the view of environmental protection and energy reclamation, and is studied in a variety of manners. As one field of such a waste plastic reclamation, the recovery of fuels from waste plastics is recognized.

The conventional methods for the recovery of fuels from waste plastics mostly enable the production of kerosene, diesel oil and/or a mixture thereof. However, due to technical problems associated with a process and equipment, such as a pre-treatment of the waste plastic raw material, a cracking, a fractionation, and a refining, etc., there is no report for the production of gasoline, in particular for automobiles, using the waste plastics.

Gasoline generally designates volatile, combustible liquid hydrocarbons obtained by the reforming distillation, polymerization, catalytic cracking, and alkylation, etc. of crude oil. In most countries, octane number, distillation property, and allowable contents of harmful substances, such as lead or sulfur components, for gasoline, are provided under the law. In particular, the octane number and the distillation property are the most important quality standards of a fuel for an automobile internal combustion engine. Gasoline produced in an oil refinery conforms to the quality standards provided under the law, by combining a low- or high-boiling fraction of a low or high octane number to a mixed product of a product from a Fluid Catalyst Cracking Unit (FCCU) and a product resulted from the reforming of a high-boiling fraction from the hydrocracking of naphtha produced in the atmospheric distillation of crude oil. For this reason, the use of waste plastic for production of gasoline is difficult to meet with the quality standards.

Waste plastics, that are polymers of a high molecular weight, have a problem in that, upon a simple thermal decomposition, they produce mainly a wax fraction, with little or no production of gasoline, kerosene, and light oil, due to a decomposition property thereof.

Therefore, as solutions for the above problem, there are proposed thermal decomposition methods using a solid acid as a catalyst. A drawback with these methods is, however, that $C_1$ to $C_3$ waste gases, and a mixed oil fraction of $C_8$ to $C_{25}$ kerosene and diesel oil are mainly produced, while an oil fraction of 4 to 25 carbon atoms which is main component is not produced in a good yield. As a result, the reclamation of waste plastic is limited only to the mixed oil.

In addition to this drawback, the above thermal decomposition method has another problem in that coke and polymeric materials, that are formed during the catalytic cracking of waste plastic melt, directly form a barrier to a catalyst surface, such that a serious catalytic poison phenomenon occurs, thereby reducing rapidly the catalyst activity. For this reason, a method is used in which simply thermally decomposed gaseous oil is partially cracked and isomerized by passing the gaseous oil through a fixed bed reactor filled with a catalyst. However, this method has a problem in that, since the temperature in the fixed bed is lower than that in the thermal decomposition, a reaction conversion is seriously limited. Moreover, in this method, the regeneration and the replacement of the catalyst due to the catalytic poison phenomenon require significant cost, and are also very complicated. Owing to these disadvantages, this method is limited in its application to the commercial facility. Additionally, this method is relatively low in production of gasoline oil fraction, and thus was not believed to be suitable for the production of gasoline.

SUMMARY OF THE INVENTION

It is a first object of the present invention to provide a method for continuously preparing gasoline, kerosene, and diesel oil from waste plastics, which is capable of preparing a gasoline-based fraction of a good quality at a high fraction.

It is a second object of the present invention to provide a method for continuously preparing gasoline, kerosene and diesel oil, which can contribute to environmental protection due to an efficient reclamation of waste plastics.

It is a third object of the present invention to provide a system for continuously preparing gasoline, kerosene, and diesel oil, according to the first and second objects as described above.

According to one preferred aspect for accomplishing the first object of the present invention, there is provided a method for the continuous preparation of gasoline, kerosene, and diesel oil, comprising the steps of: subjecting waste plastics to a first catalytic reaction to be dehydrogenated while being decomposed; subjecting the dehydrogenated and decomposed waste plastic melt to a moving-bed catalytic cracking to produce a gasoline-based fraction at a high fraction; and fractionating the resulting material into the gasoline-based fraction, kerosene fraction, and diesel oil fraction.

According to another preferred aspect for accomplishing the second object of the present invention, there is provided a method for the continuous preparation of gasoline, kerosene, and diesel oil, which further comprises the step of reforming the gasoline-based oil fraction, after the fractionating step mentioned in the above aspect for accomplishing the first and second objects.

According to another preferred aspect for accomplishing the above first and second objects, there is provided a method for the continuous preparation of gasoline, kerosene, and diesel oil, which further comprises the steps of: after the reforming step, subjecting the reformed gasoline-based fraction to a low-pressure gas separation; refining the kerosene and diesel oil fractions from the fractionating step, and the reformed gasoline-based fraction from the low-pressure gas separation step, respectively; and adding at least one additive to the refined gasoline-based oil fraction depending on instrumental analysis results thereof, such that the resulting gasoline-based fraction has an octane number and distillation property meeting the law.

According to another preferred aspect for accomplishing the above third object of the present invention, there is provided a system for continuously preparing gasoline, kerosene, and diesel oil from waste plastics, which comprises: a moving-bed catalytic cracker, in which a waste plastic melt and an alumina silicate solid acid catalyst particles are introduced downwardly, and cracked and isomerized, and into which steam generated from a steam injector is injected through its lower portion to vaporize non-vaporized gaseous oil present on the catalyst surface, and also which is communicated with a fractionating column via a pressure controlling means at its upper portion; a cyclone disposed outside of the moving-bed catalytic column and serving to sort only the catalyst particle of a desired size among the catalyst particles dropped to the lower portion; and a nickel-molybdenum catalyst regenerator including an air injector and an exhaust gas pressure controller, and serving to regenerate the catalyst transferred from the cyclone, and to return the regenerated catalyst to the moving-bed catalytic cracker.

According to another preferred aspect for accomplishing the third object of the present invention, there is provided a system for continuously preparing gasoline, kerosene, and diesel oil, which, additionally to the elements mentioned in the just above system, further comprises a reactor serving to bring the waste plastic melt into contact with a nickel or nickel catalyst impeller to dehydrogenate while decomposing the waste plastic melt, the reactor being communicated with the moving-bed catalytic cracker and the catalyst regenerator.

According to another preferred aspect for accomplishing the third object of the present invention, there is provided a system for continuously preparing gasoline, kerosene, and diesel oil, which, additionally to the elements mentioned in the just above system, further comprises a storage tank for a reforming super acid catalyst; a first super mixer serving to mix the gasoline-based fraction with the reforming catalyst; and a reforming reactor.

BRIEF DESCRIPTION OF THE DRAWINGS

Other objects and aspects of the invention will be apparent from the following description of embodiments with reference to the accompanying drawings, in which.

DETAILED DESCRIPTION OF THE INVENTION

The system according to the present invention adopts a continuous preparation manner, and has the constructional elements as follows:

First, a pre-treating and melting device of waste plastic raw material, and optionally, an impurity-removing device.

Second, a first reactor serving to dehydrogenate while decomposing the waste plastic melt.

Third, a second reactor serving to subject the dehydrogenated and decomposed waste plastic melt to a moving-bed catalytic cracking, thereby to produce a gasoline-based fraction at a relatively high fraction, a kerosene fraction, and a diesel oil fraction.

Fourth, an Aspen fractionation column which can optionally included and has a process fluctuation-attentuating function for the efficient and exact separation.

Fifth, a third reactor serving to reform the gasoline-based fraction to be converted into a high octane gasoline-based fraction.

Sixth, a precipitation-separation tank which is optionally included and serves to remove a variety of additives contained in the gasoline-based fraction, the kerosene oil fraction and the diesel oil fraction, respectively, such that the additive contents are below a normal value provided under the law.

Seventh, a blender that is optionally included and serves to provide a gasoline meeting with the provisions under the law, by batchwise or continuously conducting the instrumental analysis of the gasoline-based fraction, and then by blending the oil fraction with a blend stock according to the obtained analysis result, to meet the octane number and distillation property of the oil fraction with the normal value provided under the law.

The continuous method for the preparation of gasoline, kerosene, and diesel oil from waste plastics, according to the present invention, is advantageous in that the kerosene and diesel oil fractions, that were resulted from the fractionation of the catalytically cracked gaseous oil in the fractionating column, are rich in isomerized fraction, as they were already reformed to a significant level in the moving-bed catalytic cracking step. For this reason, the kerosene and diesel fractions are decreased in freezing point and thus are not problematic in the transfer and storage in the winter season or a cold region having a relatively high frequency of use. In addition, they meet with the quality standard of fuels.

The present invention will now be described in detail with reference to the accompanying drawings. For convenience of description, the reference to FIG. 1 will be made together with the reference to FIG. 2.

Figure 1:
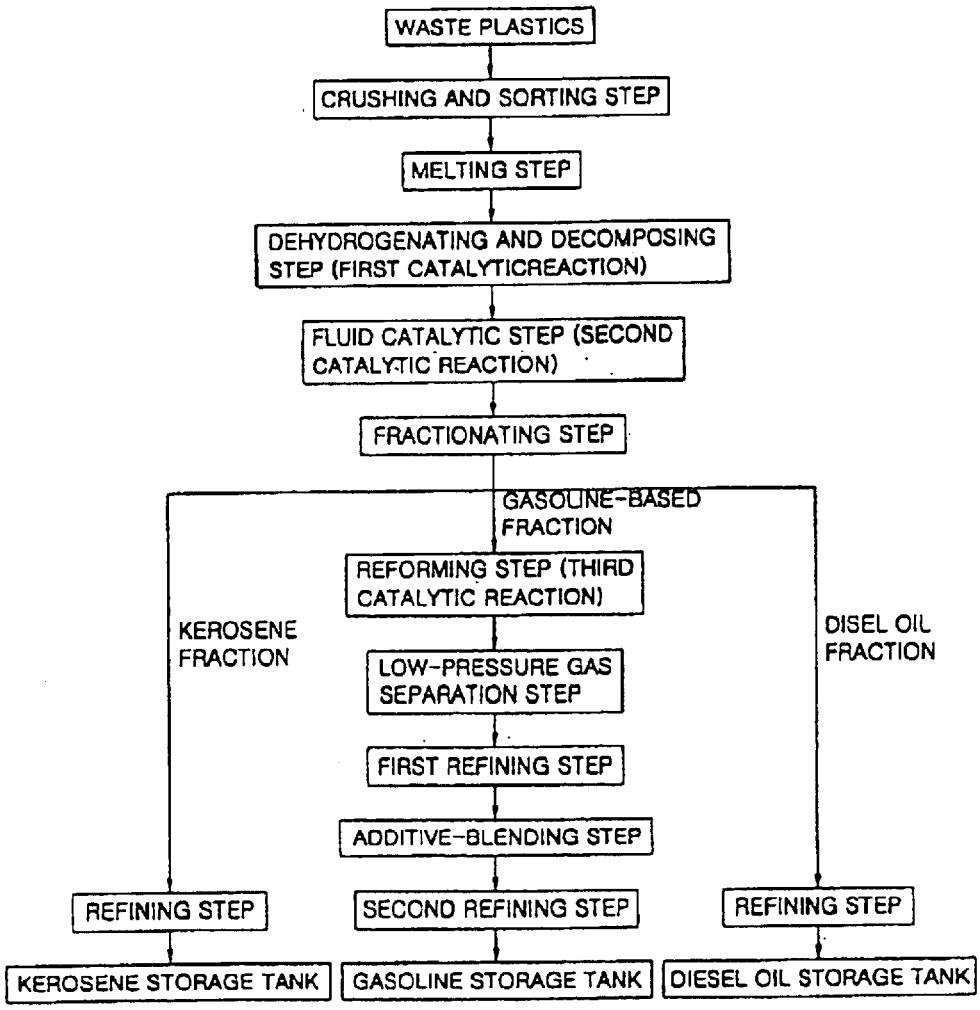
FIG. 1 is a flow chart schematically showing a continuous method according to the present invention.
Figure 2:
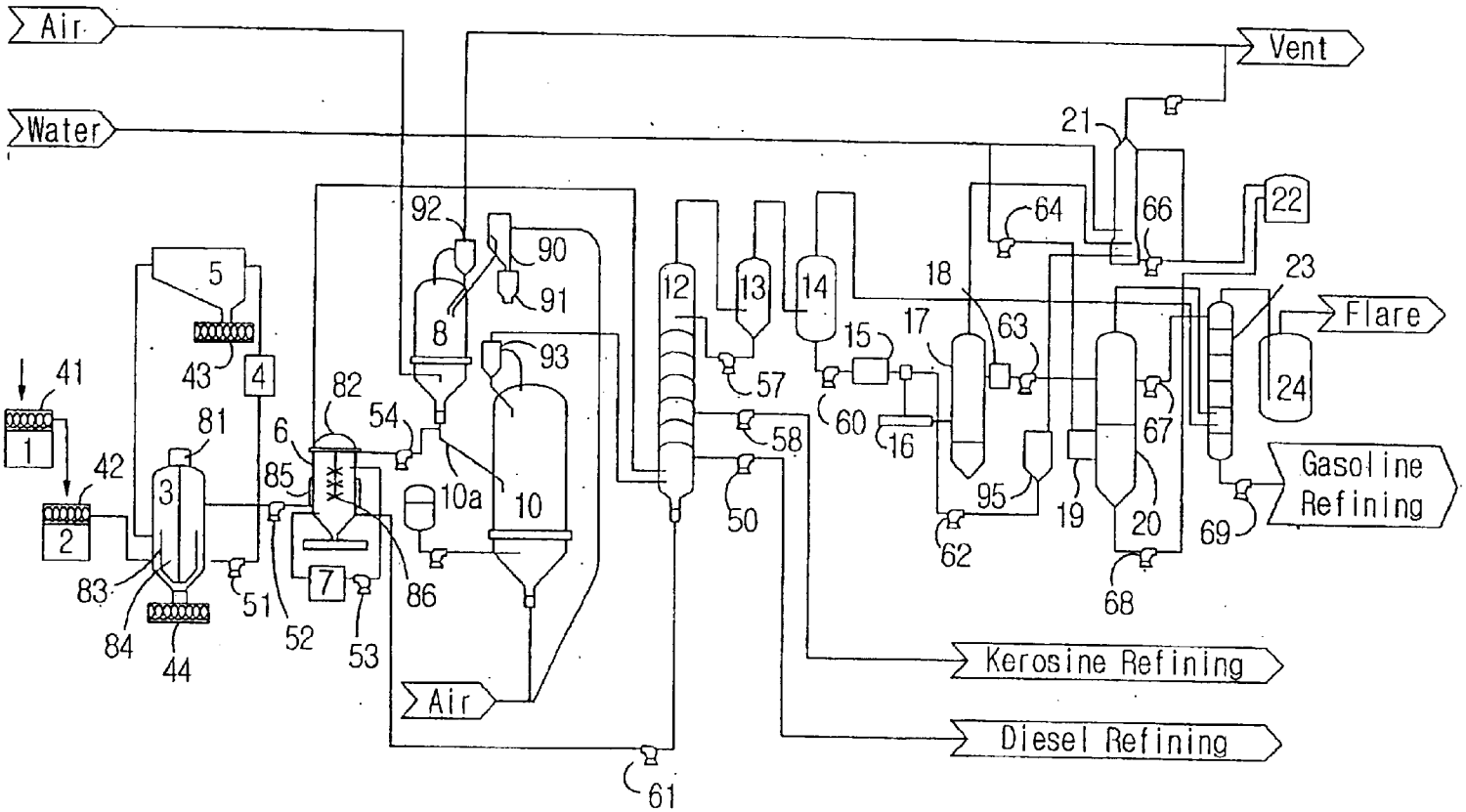
FIG. 2 and FIG. 3 schematically show a system according to the present invention.
Figure 3:
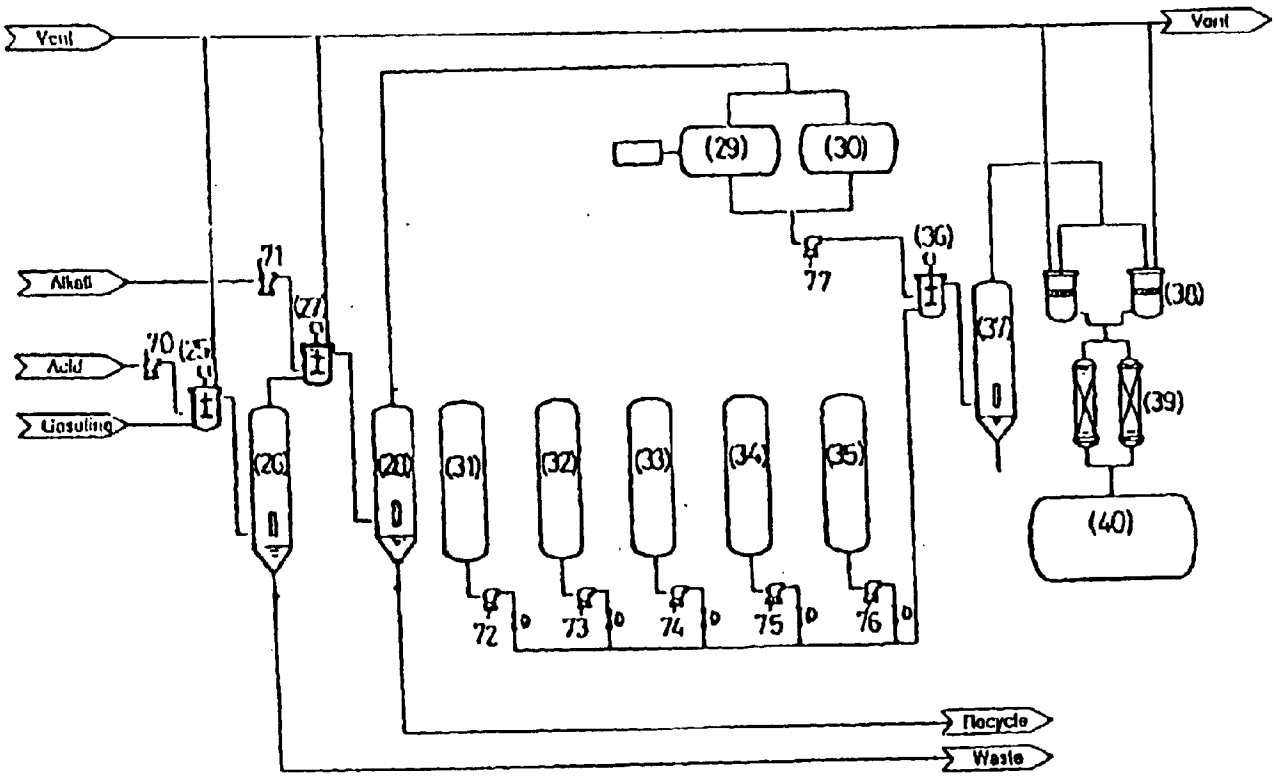

FIG. 1 is a flow chart schematically showing a method for the continuous preparation of gasoline, kerosene and diesel oil according to an embodiment of the present invention, and FIGS. 2 and 3 are drawings schematically showing a system of the present invention. The description referring to the drawings will now be made in processing step order.

First, a pretreatment is carried out which consists of a crushing and sorting step, a melting step and an impurity-precipitating step. In the crushing and sorting step, collected waste plastics are crushed into a chip size for easiness of the transfer and melting, and impurities are sorted out and removed. The size of the crushed waste plastics is not critical to the present invention. The crushing rate of the waste plastics may be, for example, about 1000 kg waste plastics/hr, but it is, of course, varied depending on the scale of the crushing facility.

Meanwhile, the term "waste plastics" as used herein collectively mean natural and synthetic resins. The waste plastics preferably designate thermoplastics, but do not exclude thermosetting resins. More preferably, the waste plastics include, but are not limited to, polyethylene, polypropylene, and polystyrene, etc.

Subsequently, in a melting step, the crushed waste plastics are transferred by a screw feeder 41 into raw material-melting devices 1 and 2 herein the crushed and sorted waste plastics are melted. In an embodiment shown in FIG. 2, the waste plastic melt is stirred with a rotor 83 rotating with a motor 81 in a first melting device, while firstly melting the waste plastic chips. Then, the melt is dewatered to have a water content of about 10% or less, followed by elevating to 150° C. After this, the melt is introduced into a second melting device 2 with a screw feeder 42, and further elevated to a temperature of about 340 to 360° C. to be secondly melted therein. The secondly melted waste plastics are introduced into a raw material melting tank 3. Earth and fine impurities, etc., that are precipitated on the bottom of the raw material melting tank, are eliminated from the system using a discharge screw 44.

The waste plastic melt is melted, in the melting tank 3 such that it is completely homogeneous. In the impurity-precipitating step, the homogeneous waste plastic mixture is entered into a precipitating tank 5 by a rotary pump 51, which tank 5 is maintained at a temperature of about 340° C. to 360° C. and is slanted at its bottom. In the precipitating tank 5, earth and fine impurities, etc. are precipitated and removed. Meanwhile, the waste plastic melt being transferred with the rotary pump 51 is maintained at about 350° C. by compensating for lost heat with a heat from a first external circulating heater 4. If crushing rate of the waste plastics is, for example, as described above, the transfer rate of the melt is, for example, about 5,000 liter/minute (LPM), but it can be also varied. Earth and fine impurities precipitated on the bottom of the precipitating tank 4 are eliminated with a discharge screw 43 from the system. The precipitating tank 5 may also be equipped with a heater (not shown)

Next, a dehydrogenating and decomposing step (a first catalytic reaction step) is carried out. In this step, the waste plastic melt, from which the impurities were removed by the above pretreatment step, is introduced into a first reactor at a constant flow rate (about 15 to 18 LPM for the above described crushing rate) through a metering pump 52. The introduced waste plastic melt is brought into contact with a catalyst impeller 86 rotating with a motor 82 (preferably an impeller made of nickel or nickel alloy) at a temperature of 350° C. to 370° C., thereby being dehydrogenated and decomposed. Also, it is preferred in view of reactivity and output to control impeller rpm/impeller/flow rate (for example, 180 rpm/8-blades-4 stage disk turbine/5 cm/mm upward flow, for the above crushing rate), such that the reaction segment for flow rate is below 10 to 20 $\mu$m. The residence time of the raw material in the first reactor is in the range of about 20 to 35 minutes.

In particular, the impeller has preferably a multiple stage turbine blade type such that the waste plastic raw material flow is maintained at a plug flow. A baffle and a disc hole advantageously act as assistants for the maintenance of the plug flow.

The nickel alloy catalyst conducts the dehydrogenation of the polymer at a high temperature, such as about 350° C. to 370° C., and the cracking of the polymer at its weak points, simultaneously. In this step, as thermal cracking or catalytic cracking does not still in earnest occur, there occurs no catalytic poison problem by the formation of a barrier on the catalyst surface.

By this dehydrogenation and decomposition step, the raw material is reduced in molecular weight to a level of ⅛ to 1/12.

Supply of heat to the first reactor is carried out by an operation of a pump 53 with a second external-circulating heater 7. A heater 85 may also be installed outside of the first reactor 6.

Subsequently, the waste plastic melt raw material, which was passed through the first catalytic reaction, i.e., the dehydrogenation and decomposition step, is subjected to a moving-bed catalytic cracking. The raw material being transferred by a high pressure pump 54 is intensively reacted with a catalyst introduced from a catalyst regenerator 8, in a narrow space inside of a moving-bed catalytic cracking pipe 10*a*, whose temperature is maintained at 500° C. to 550° C. While reacting as such, the raw material is introduced into the moving-bed catalytic cracker 10 (a second reactor) eta pressure of 10 kg/cm$^2$ and a flow rate of about 15 to 18 LPH (for the above crushing rate). The reaction of the raw material is completed in the moving-bed catalytic cracker 10, while the catalyst is dropped downwardly to the bottom of the moving-bed catalytic cracker. In this reaction, the raw material is instantly cracked upon contact with the catalyst, and then expanded by about 18 times in volume. Simultaneously with this expansion, it is rapidly diffused into pores of the catalyst to be further cracked and isomerized.

As the catalyst used in the above reaction, the conventional alumina silica ($SiO_2$—$Al_2O_3$) solid acid catalyst is preferred, but is not limited thereto. The low molecular weight gas, which was cracked at a temperature of about 500° C. to 550° C., is in contact with the wide pore face inside of the catalyst, while being reformed and aromatized by the second reaction.

The time, during which the raw material is passed through the moving-bed catalytic reactor, is determined depending on the diffusion velocity. Moreover, it is preferred that the catalyst is introduced downwardly from the upper portion, because it results in a significant reduction in equipment cost, and at the same time, is advantageous in making equipment smaller in size.

The catalyst and the gaseous oil, that were passed through the moving-bed, are separated from each other in the second reactor 10. In so doing, it is preferred to control the heat balance and the material balance, such that 90% or more of the raw material is finally cracked. Such a control will be obvious to a person skilled in the art.

The portion of gaseous oil, which is not removed from the surface of the catalyst, is vaporized with the vaporization of steam produced from a steam generator 11 and supplied to the lower portion of the second reactor 10 at a molar ratio of 14%. As a result, less than 10% of the gaseous oil remains non-vaporized.

At a location spaced upwardly apart from the upper portion of the moving-bed catalytic cracker 10 as the second reactor, there is disposed an exhaust gas pressure-controlling means 93. This pressure-controlling means serves to maintain always the pressure of the cracker 10 at a level higher than that of a lower portion (a portion communicated with the cracker) of a fractionating column 10, thereby preventing a countercurrent flow from the fractionating column 10.

At a location spaced apart from the lower portion of the moving-bed catalytic cracker 10 as the second reactor, there is positioned an ejector (not shown) ejecting air at a pressure of about 5 kg/cm$^2$. This ejector serves to send the catalyst particle being dropped downwardly in the cracker 10, to an external cyclone 90 communicated with a catalyst regenerator 8. From this external cyclone 90, the catalyst powders formed into a bridge are withdrawn into a storage vessel 91 and removed, whereas the remaining catalyst particles are introduced into the catalyst regenerator 8 at a temperature in the range of about 460° C. to 490° C.

Into the catalyst regenerator 8, air is introduced at a flow rate of 19.7 kg/mm (which is a rate according to a heat balance) for the case of the above crushing amount) and maintained at about 650° C., while oxidizing all cokes remained in the catalyst. The circulating amount of the catalyst is determined depending on the heat balance. That is to say, there is no heating other than the initial heating. In the case of the above crushing rate, the circulating amount of the catalyst amount is about 100 to 105 liter/mm. Meanwhile, the control of temperature with no dependence on the heat and material balances either can result in a reduction in reactive efficiency in the moving-bed due to an incompletely regenerated catalyst or can result in a collapse phenomenon of the catalyst regenerator 8 due to a high temperature. The catalyst regenerator 8 can be made of Ni—Mo alloy, for example, such as Incolloy 800 HT which is commercially available.

On the lower portion of the catalyst regenerator 8, there is disposed a grid having an obstruction function, and connected to an air distributor. The grid and the air distributor are designed in such a manner that they can supply a pressure sufficient to cope with head of the catalyst regenerator 8. The grid has air holes that can be 1.5 mm in diameter and about 1,800 in number. At a location spaced apart from the upper portion of the catalyst regenerator 8, an external cyclone 90 and an exhaust gas pressure-controlling means 92 are arranged. The exhaust gas pressure-controlling means 92 serves to maintain the pressure in the catalyst regenerator 8 at a pressure level higher than that in the moving-bed catalytic cracker 10 and in the lower portion (the portion communicated with the cracker 10) of the fractionating column 12, thereby preventing a countercurrent flow from the fractionating column 12 and the catalytic cracker 10.

Thereafter, a fractionating step is carried out. In this fractionating step, a gaseous oil vented from the upper portion of the first reactor 6 and a gaseous oil cracked and isomerized in the moving-bed catalytic cracker 10, as the second reactor, are subjected to a gas-liquid contact in the fractionating column 12. By this gas-liquid contact, the gaseous oils are separated into a kerosene fraction, a diesel oil fraction, and a gasoline-based fraction. With respect to this fractionating column, a stage number and a tray type are determined for the exact separation efficiency. In the case of the above crushing rate, a column having a diameter of 600 mm, a stage number of 21 and a bubble cap type can be used. The respective discharge lines have a pump and the respective fractions are controlled at an exactly calculated temperature. The kerosene fraction is controlled at temperature of 160 to 200° C., the diesel oil fraction at 240 to 320° C., and liquefied oil from the bottom of the fractionating column at 350 to 380° C. The liquefied oil effluent from the bottom of the fractionating column 12 is returned to the first reactor 6 with a pump 61 while being maintained at a constant level in the fractionating column 12.

The diesel oil fraction and the kerosene fraction effluent from the lower portion and the middle portion of the fractionating column 12, respectively, are transferred as such with pumps 50 and 58 for a refining step.

Meanwhile, the gasoline-based fraction effluent from the upper portion of the fractionating column 12 will be passed through a reforming step. The gasoline-based oil fraction is recycled in the fractionating column 12 by a reflux ratio, while being stored for the moment in a gasoline-based fraction-recycling tank 13 by a gas-liquid contact manner. Then, the bottom product from the tank 13 is recycled to the fractionating column 12 with a pump 57, and a collected gasoline-based fraction is condensed at 25° C. and stored in a surge tank 14. A low-pressure gas vented from the upper portion of the surge tank 14 is transferred to a low-pressure gas collector (a liquid contactor) 23 to be separated therein.

Meanwhile, the gasoline-based fraction from the surge tank 14 is transferred by a pump 61 to a preheater 15 wherein it is preheated to a temperature of 90 to 120° C. Then, the preheated fraction is dispersed and stirred by a first super mixer 16 along with a reforming catalyst transferred from a reforming catalyst storage tank 95 through a pump 62, and thus is homogenized. Such homogenized mixture is isomerized, and introduced into a reforming reactor 17, as a third reactor, for example, at a flow rate of 8 to 12 LPM for the case of the above crushing rate.

The reforming catalyst is a super acid catalyst, and preferably HCl, $AlCl_3$ or $SbCl_3$, and the gasoline-based fraction is blended with the super acid catalyst in a blending ratio of 1/50 to 1/100 by molar ratio. The super acid catalyst induces a double bond of the gasoline fraction at a temperature of about 90 to 120° C. by a strong acid action, to convert the gasoline fraction to a secondary carbonium and then a tertiary carbonium, thereby leading the gasoline fraction to the isomerization. In this procedure, the conversion significantly depends on the dispersed degree of the catalyst. However, too small particle size of the catalyst is problematic in that it increases a loss factor of the catalyst, and also results in the contamination of a product. As a result, the particle size and the separation time are in a close relation to each other.

As the reforming step is proceeded under a strong acid condition, the third reactor 17 needs to be made of a corrosion resistance material. In the third reactor 17, the catalyst and the reformed gasoline fraction are separated by specific gravity, and the separation time is determined from the calculated sedimentation velocity. The separation time is about 40 minutes for the case of the above crushing rate. The separated and precipitated catalyst is continued to circulate at a rate of 200 to 300 cc/mm and periodically replenished in loss fraction.

An acid steam effluent from the third reactor 17, as the reforming reactor, is dissolved in water to be scrubbed, in an acid scrubber 21, and then transferred by a pump 66 to a neutralizing tank 22 wherein it is neutralized.

Meanwhile, the gasoline-based fraction (the reformed fraction) as described above is passed through a cooler 18, and homogeneously mixed with water transferred via a pump 64 at a ratio of about 1:1, in a super mixer 19.

The homogenized mixture is left to stand and subjected to a phase separation in a first refining tank 20. Then, the lower aqueous layer, in which the acid is dissolved, is drained with a pump 68 and transferred into a neutralizing tank 22 and neutralized therein.

Afterwards, a low-pressure gas separation step is carried out. In a low-pressure gas separation column 23, gases vented from the gasoline-based fraction-recycling tank 14 and from the upper portion of the first refining tank 20, and the reformed gasoline fraction transferred by a pump 67 from the oily layer in the first refining tank 20, are subjected to a gas-liquid contact, to be separated into a reformed oil fraction and a gas. The separated gas is transferred to a knock-out tank 24, while the separated reformed oil fraction is transferred to an acid mixer 25 by a pump 69.

Thereafter, the completely reformed oil fraction, as the gasoline-based fraction, and the kerosene and diesel oil fractions separated in the moving-bed catalytic cracking step are transferred to a first refining step.

The reformed gasoline-based fraction or the fractionated kerosene and diesel oil fractions, respectively, are condensed and mixed with an acid solution (e.g., a 1 to 2 mol % sulfuric acid solution) transferred by a pump 70, in the acid mixer 25.

Following this, the mixture is transferred to a second refining tank 26, as a precipitation and separation tank, and then condensed and mixed with an alkaline solution (e.g., a 3 to 5 mol % sodium hydroxide solution) transferred by a pump 71, in an alkali mixer. Next, the mixture is transferred to a third refining tank 28, as a precipitation and separation tank. The used acid solution is disposed of after neutralizing, and the used condensed alkaline solution is reused after being purified. The second and third refining tanks 26 and 28 are designed in such a manner that they can separate a three-phase system to remove acid or alkaline condensate in middle and lower layers present beneath the oil fraction layer, as the upper layer, and having a variety of dissolved additives. For example, a drain valve can be equipped with for the middle layer and the lower layer, respectively.

The kerosene and diesel oil fractions, which were passed through the above refining step, are transferred to the respective storage tank (not shown) and stored as a final product therein. Alternatively, these fractions are stored via an additive-blending step and a second refining step as described below. The stored oil fractions are ready to use as fuel oil, respectively.

Meanwhile, the first refined oil fraction, as the gasoline-based fraction, which was passed through the above refining step, is stored in gasoline-based fraction surge tanks 29 and 30. In the present invention, although the above surge tanks are not specifically limited in their number, the use of the plurality of surge tanks, such as two or more surge tanks, is preferred in view of a process efficiency when considering characteristics of the continuous process.

The first refined oil fraction stored in the gasoline-based fraction surge tanks 29 and 30 is monitored. In this monitoring, the oil fraction is analyzed for its components with a suitable instrumental analysis means, such as gas chromatography. Depending on results of the monitoring, additives for the control of the octane number and the distillation property are blended with the oil fraction in a suitable ratio, thereby obtaining gasoline meeting with provisions under the law.

Tanks, which can be established for the storage of the additives, include an antioxidant storage tank 31, storage tanks 32 and 33 for high-octane number additives, such as a $C_4$ light, high-octane number additive, and a $C_4$ heavy, high-octane number additive, etc., a storage tank 34 for low-boiling point and low-octane number additives, such as light, low-octane number linear straight run $C_5$–$C_7$ saturated hydrocarbons, and light, low-octane number linear straight run $C_5$–$C_7$ n-paraffins, etc., and a storage tank 35 for low-boiling point and high-octane number additives, such as methyl t-butylether, etc.

Depending on the component analysis results of the first refined oil fraction, a desired amount of the first refined oil fraction is transferred to a blender 36 by a pump 77, while desired amount and kind of additives are transferred from the additive tanks 31, 32, 33, 34, and/or 35 to the blender 36 by the respective pumps 72, 73, 74, 75 and/or 76. The transferred additives are blended with the first refined oil fraction in the blender 36, thereby making the oil fraction meeting with provisions under the law.

Then, the blended gasoline from the blender 36 is sent to a second refining step. For the second refining, the blended gasoline is transferred to a fourth refining tank 37 and separated by specific gravity therein. The separated gasoline is filtered through a filter 38, after which the filtered gasoline is passed to an absorber filled with activated carbon in which it is decolorized. Next, the resulting gasoline is stored in a gasoline storage tank 40.

In the method and system for the preparation of gasoline, kerosene, and diesel oil from waste plastics, polyethylene, polypropylene, and polystyrene, etc. in the waste plastics are in principle introduced at a possible constant ratio, because a blending ratio of the polymers has an affect on a quality of products. In this regard, a blending receipt of the polymers is determined depending on analysis results. For reference, such a blend preparation step is also applied in the existing oil refineries, and is an essential process for the preparation of gasoline.

Furthermore, blend stocks mount up to ten in their kind, and are suitably chosen case by case depending on a variety of parameters, such as seasons, and a blending ratio of the fed raw materials, etc. It is particularly important to add the blend stock in such a manner that the distillation property of products meets with the law. Where polystyrene resin is added at a great amount and thus, $C_7$–$C_9$ aromatic components are significantly contained, for example, it is preferred to decrease an adding amount of $C_9$ aromatic component while blending a relatively large amount of $C_5$ fraction, thereby controlling the octane number.

The gasoline-based fraction, which was passed through the reforming step of the present invention, is about 85 to 90 in average octane number, but this average octane number can be increased to a level of 93 to 96 when the blend stocks are added.

In addition, in the preparing method and system of the present invention, the treatment of 100 parts by weight of waste plastics, as the raw material, produces 39 to 42 part by weight of gasoline-based fraction, 9 to 12 parts of kerosene fraction, 9 to 11 parts by weight of diesel fraction, 7 to 11 parts by weight of waste gas, and 8 to 11 parts by weight of waste components.

Table 1 below illustrates an example of a blend for preparing gasoline using the gasoline-based fraction prepared according to the present invention.

TABLE 1

| Component (Blend stock) | Octane Number | Blending ratio | Weight octane Number |
|---|---|---|---|
| Reformed fraction | 85–90 | 70% | 59.5 to 63 |
| $C_4$ component | 94 | 5% | 4.7 |
| $C_9$ aromatic component | 117 | 10% | 11.7 |
| MTBE | 115 | 15% | 17.25 |
| Total | | | 93.15 to 96.40 |

MTBE: methyl t-butylether

As apparent from the above description, the present invention provides the method and system for the continuous preparation of gasoline, kerosene and diesel oil from waste plastics. Such method and system adopts the moving-bed catalytic cracking manner, in which the first catalytically reacted raw material and the catalyst particles are in contact with each other while moving downwardly, and includes the reforming with the circulating catalyst. Thus, the present invention exhibits a high conversion, while efficiently eliminating problems due to the catalyst poison phenomenon. Moreover, the present invention can commercially apply to a small scale facility, not to apply to a large scale facility. In addition, the present invention allows the gasoline fraction to be produced at a relatively high fraction, and also greatly contributes to waste resource reclamation and environmental protection.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A system for continuously preparing gasoline, kerosene, and diesel oil from waste plastics, which comprises:

a moving-bed catalytic cracker, in which a melt of the waste plastics and an alumina silicate solid acid catalyst particles are introduced downwardly from the upper portion thereof, and cracked and isomerized, and into which steam is injected through its lower portion to vaporize non-vaporized gaseous oil present on the catalyst surface, the moving-bed catalytic cracker being communicated with a fractionating column through a pressure controlling means disposed at a position spaced apart from the top thereof;

a cyclone disposed outside of the moving-bed catalytic cracker and serving to sort only the catalyst particle of a desired size among the catalyst particles dropped to the bottom of the moving-bed catalytic cracker; and a catalyst regenerator made of nickel-molybdenum including an air injector and an exhaust gas pressure controller, and serving to regenerate the catalyst transferred from the cyclone and to return the regenerated catalyst to the moving-bed catalytic cracker.

2. The system of claim 1, which further comprises a reactor in which the waste plastic melt is in contact with a nickel or nickel alloy catalyst impeller to be dehydrogenated while being decomposed, the reactor being communicated with the moving-bed catalytic cracker and the catalyst regenerator.

3. The system of claim 2, which further comprises an waste plastic-melting device which is communicated with the reactor, a heater and a precipitating tank for removing impurities in the waste plastics, the heater and the precipitating tank being disposed outside of the waste plastic-melting device.

4. The system of claim 1, in which the upper portion and the lower portion of the moving-bed catalytic cracker are communicated with each other, and the system further comprises a fractionating column, wherein, the upper portion of the fractionating column is communicated with a gasoline-based fraction-recycling tank and a surge tank, the middle portion of the fractionating column is communicated with a kerosene fraction-refining means, and the lower portion of the fractionating column is communicated with a diesel oil fraction-refining means.

5. The system of claim 2, in which the fractionating column is an Aspen-fractionating column having a bubble cap tray type.

6. The system of claim 4, which further comprises:

a preheater for heating the gasoline-based fraction effluent from the surge tank;

a storage tank for a reforming catalyst of super acid; and a first super mixer for mixing the gasoline-based fraction from the preheater with the reforming catalyst from the reforming catalyst storage tank.

7. The system of claim 6, which further comprises:

a reforming reactor to which the mixture from the super mixer is transferred, and which serves to reform the gasoline-based fraction;

a second super mixer serving to mix the reformed gasoline-based fraction with water; and a first refining tank serving as a phase separator and communicated with the second super mixer.

8. The system of claim 4, which further comprises:

a liquid contactor serving to bring the reformed gasoline-based fraction from the first refining tank into a gas-liquid contact to separate a low-pressure gas;

an acid-mixing tank and an acid-separating tank serving to refine the kerosene and diesel oil fractions effluent from the fractionating column and the gasoline-based fraction from the liquid contact scrubber, respectively; and an alkali-mixing tank and an alkali-separating tank communicated with the acid-separating tank.

9. The system of claim 7, which further comprises:

a liquid contactor serving to bring the reformed gasoline-based fraction from the first refining tank into a gas-liquid contact to separate a low-pressure gas;

an acid-mixing tank and an acid-separating tank serving to refine the kerosene and diesel oil fractions effluent from the fractionating column and the gasoline-based fraction from the liquid contact scrubber, respectively; and an alkali-mixing tank and an alkali-separating tank communicated with the acid-separating tank.

10. The system of claim 8, which further comprises:

at least one blender serving to add a variety of additives to the gasoline-based fraction effluent from the alkali-separating tank, according to an instrumental analysis result for the gasoline-based fraction, in such a manner that the gasoline-based fraction has an octane number and a distillation property meeting with the law, and at least one additive-blending tank communicated with the blender and serving to store the additives.

11. The system of claim 9, which further comprises:

at least one blender serving to add a variety of additives to the gasoline-based fraction effluent from the alkali-separating tank, according to an instrumental analysis result for the gasoline-based fraction, in such a manner that the gasoline-based fraction has an octane number and a distillation property meeting with the law, and at least one additive-blending tank communicated with the blender and serving to store the additives.

12. The system of claim 10, which further comprises:

a filer serving to filter the gasoline-based fraction to which the additive has been added; and an activated carbon absorber serving to deodorize the gasoline-based traction.

13. The system of claim 11, which further comprises:

a filer serving to filter the gasoline-based fraction to which the additive has been added; and an activated carbon absorber serving to decolorize the gasoline-based fraction.

* * * * *

UNITED STATES PATENT AND TRADEMARK OFFICE

CERTIFICATE OF CORRECTION

PATENT NO. : 6,866,830 B2
APPLICATION NO. : 10/243387
DATED : March 15, 2005
INVENTOR(S) : Ho-Jun Kwak It is certified that error appears in the above-identified patent and that said Letters Patent is hereby corrected as shown below:

Column 12 line 53 change “deodorize” to --decolorize--

Column 12 line 54 change “traction” to --fraction--

Signed and Sealed this

Fifth Day of February, 2008

JON W. DUDAS
*Director of the United States Patent and Trademark Office*